United States Patent [19]

Schrack

[11] Patent Number: 4,612,672

[45] Date of Patent: Sep. 23, 1986

[54] PROTECTIVE HEAD GEAR

[76] Inventor: Michael E. Schrack, 4435 Portola Dr., Santa Cruz, Calif. 95062

[21] Appl. No.: 698,676

[22] Filed: Feb. 6, 1985

[51] Int. Cl.[4] ..... A42B 1/12

[52] U.S. Cl. ..... 2/68; 2/411; 2/425

[58] Field of Search ..... 2/68, 425, 411

[56] References Cited

U.S. PATENT DOCUMENTS

| | | | |
|---|---|---|---|
| 3,274,612 | 9/1966 | Merriam | 2/68 X |
| 3,503,076 | 3/1970 | Marks | 2/68 |
| 3,953,892 | 5/1976 | Kennedy | 2/425 |
| 3,979,777 | 9/1976 | Gregg | 2/68 |

*Primary Examiner*—Louis K. Rimrodt

*Attorney, Agent, or Firm*—Fliesler, Dubb, Meyer & Lovejoy

[57] ABSTRACT

A floatable lightweight protective sports head gear having ring-shaped and cross-members for providing head protection, a pair of ear flaps for providing ear protection, a sun visor for providing eye protection and a chin strap for removably retaining the head gear on a wearer's head. All component parts of the head gear, except the chin strap, are made from a soft resilient closed-cell foam type material over which is provided a watertight covering. In an alternative embodiment the head gear may comprise a cap of material from which the ear flaps and visor extend in lieu of the cross-member.

7 Claims, 11 Drawing Figures

PROTECTIVE HEAD GEAR

BACKGROUND OF THE INVENTION

1. Field of the Invention

The present invention relates to protective head gear in general and to floatable, lightweight, protective, snugly fitting sports head gear for water sports in particular.

2. Description of Prior Art

Water sports including surfboarding, windsurfing, sailing, canoeing, river rafting, water polo and the like involve activities in which protective headgear should be used to prevent or minimize injuries to a user's head, eyes and ears. Preferably, the head gear should be lightweight, buoyant and provide a snug fit in addition to providing protection for a user's head, eyes and ears.

Surfboarding and windsurfing are excellent examples of water sports in which a person can benefit from wearing appropriate protective headgear. For example, a surfer who falls from his board must always be concerned about being struck in the head by his board or by the board of a following surfer.

Most often, surfing is done in bright sunlight, especially in tropical climates. After an extended period without a visor or other sun shield, a surfer's eyes may become sore and suffer from a number of conditions such as pteryguim.

Wind and water bombarding a surfer's ears and entering the ear canal over an extended period may also result in adverse medical conditions such as exostosis.

A wide variety of protective head gear comprising features for protecting a user's head, eyes and ears is available, but it is generally unsatisfactory for use in water sports. For example, a football helmet comprises a hard, rigid shell with an interior padding and/or webbing for absorbing blows to a wearer's head. The shell typically is displaced from the wearer's forehead and thus provides a degree of visor-like protection to the wearer's eyes from the effects of sunlight.

While providing head, eye and ear protection, the football helmet, even without its mask, is unsuitable for use in water sports for a number of reasons. For example, the football helmet, like similar types of headgear, is bulky and heavy. Its interior padding is not generally waterproof. The shell does not fit snugly about a wearer's head, but is retained on the wearer's head by a chin strap. If worn by a surfer, the force of water against the interior surface of the shell during a fall acting against the holding force of the chin strap could produce considerable stress and strain on the wearer's neck. Moreover, since such helmets generally do not float in water, if the helmet did come off the wearer's head, it would most likely be lost.

A majority of other types of head gear which provide head, eye and ear protection such as, for example, helmets worn by motorcyclists, baseball players while at bat, bicyclists, skateboarders, racquetball players and the like, all suffer from one or more of the above-described disadvantages of a football helmet if worn by a person engaged in watersports.

SUMMARY OF THE INVENTION

In view of the foregoing, a principal object of the present invention is a protective head gear especially adapted for use in water sports.

In accordance with the above object, there is provided a protective headgear which is lightweight, waterproof and buoyant in water and which comprises means for providing head, eye and ear protection.

In an embodiment of the invention, there is provided a ring-shaped member adapted to surround a wearer's head. A cross-member which extends from opposite edges of the ring-shaped member is adapted to cross over the top of the wearer's head. A pair of ear flaps extend downwardly from opposite edges of the ring-shaped member. A sun visor extends outwardly from a forward edge of the ring-shaped member and the ear flaps. An adjustable chin strap is provided for attachment between the bottom edges of the ear flaps.

The ring-shaped member and ear flaps, the cross-member and the sun visor are preferably cut from a closed-cell foam type sheet material from $\frac{1}{8}$ inch to $\frac{1}{4}$ inch thick, joined together as by an adhesive, and thereafter provided with a watertight covering. Alternatively, the above-described parts of the head gear could be made in one piece as by molding.

In the ear flaps, there is provided a cavity for receiving and enclosing the wearer's ear. Extending from the cavity, through and to the outside of the ear flap there is provided an auditory passageway having a non-uniform cross-section for facilitating hearing while minimizing the ingression of water into the wearer's ear.

More specifically, to form the cavity and the auditory passageway, the ring-shaped member and ear flaps are preferably formed from two substantially identically shaped pieces of the close-cell foam type sheet material. In one piece, a hole is provided in the ear flap portion thereof having the shape of the cavity. In the other piece, the auditory passageway is formed. After these steps have been performed, the two pieces are overlaid and bonded together, the ring-shaped member is formed by bonding together the ends of the above-described pieces and the visor attached.

In practice, the interior diameter and radius of the ring-shaped and cross-members is chosen to provide a snug fit about a wearer's head. This may be provided by making various sizes of the head gear or by providing a means for adjusting the size.

BRIEF DESCRIPTION OF THE DRAWING

The above and other objects, features and advantages of the present invention will become apparent from the following detailed description of the accompanying drawing in which.

DETAILED DESCRIPTION OF THE INVENTION

Figure 1:
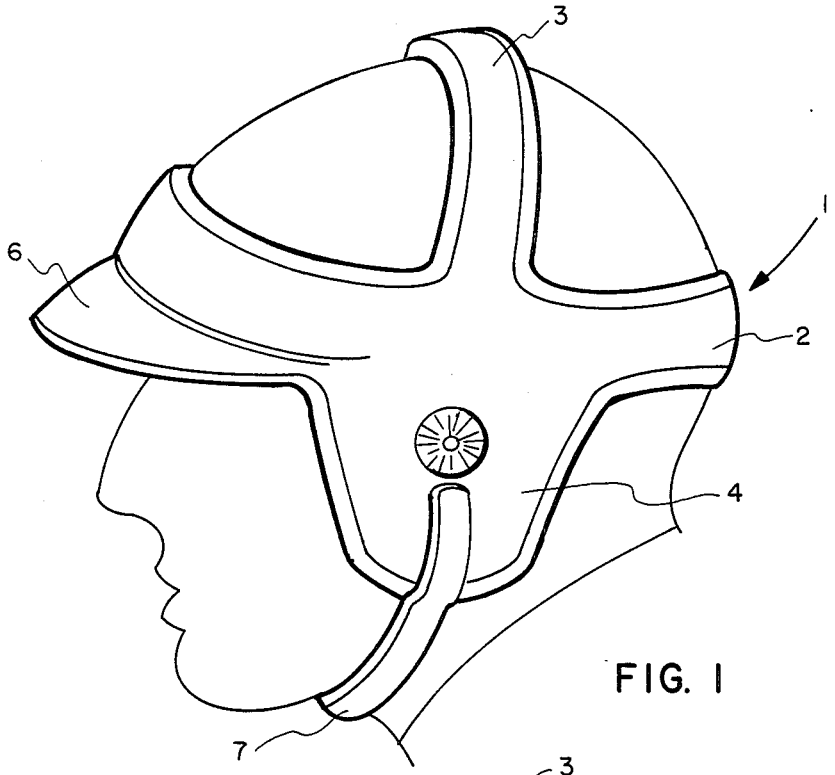
FIG. 1 is a side elevation view of an embodiment of the present invention.
Figure 2:
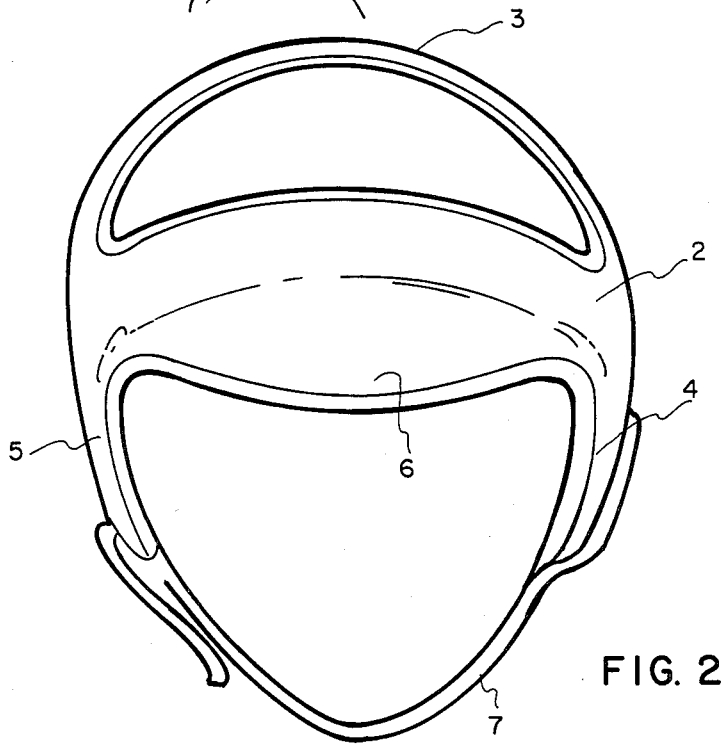
FIG. 2 is a front view of FIG. 1.
Figure 3:
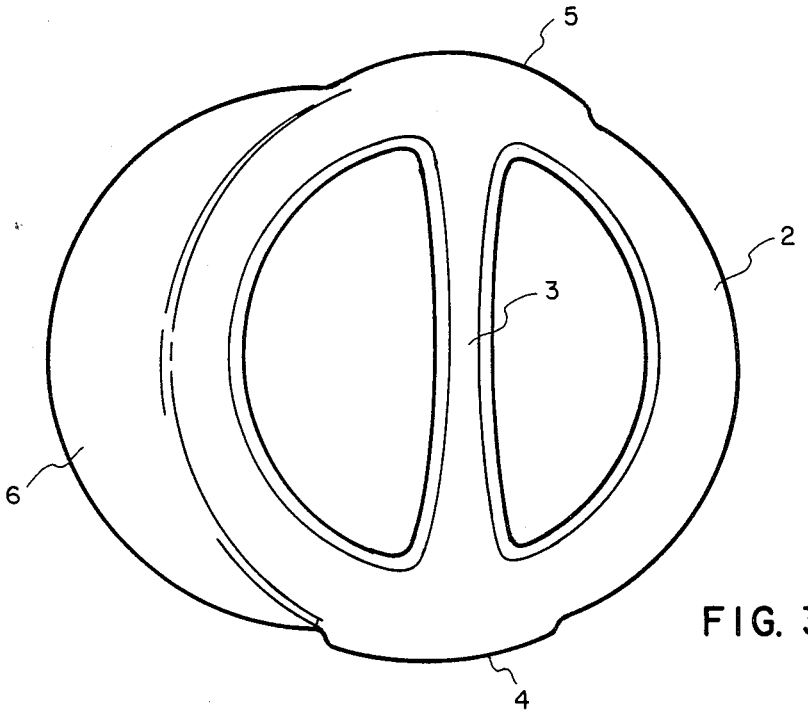
FIG. 3 is a top view of FIG. 1.
Figure 4:
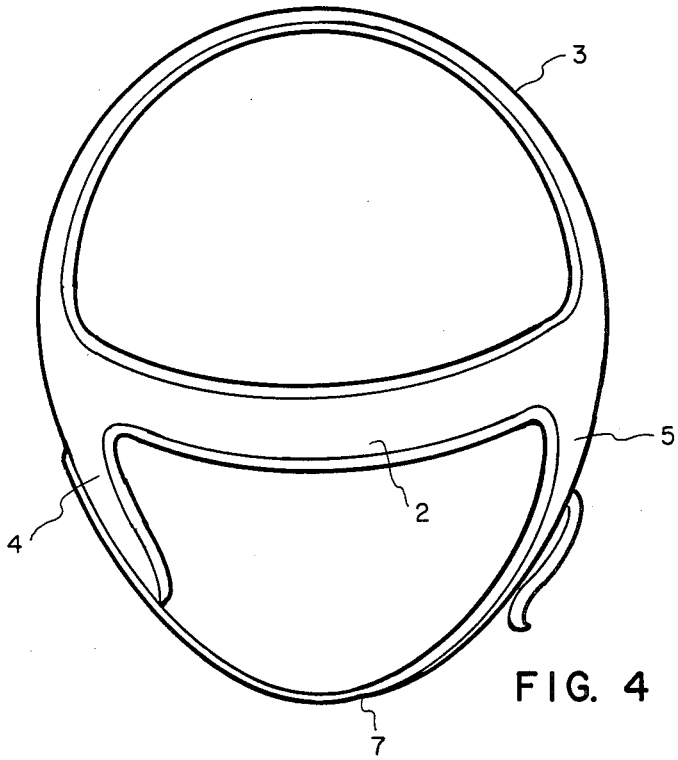
FIG. 4 is a rear view of FIG. 1.

Referring to FIGS. 1–4, there is provided in accordance with the present invention a head gear especially designed for use in water sports designated generally as 1. In the head gear 1 there is provided a ring-shaped member 2, a cross-member 3, a pair of ear flaps 4 and 5, a visor 6 and a chin strap 7.

The ring-shaped member 2 of the head gear 1 is adapted to extend around the head of a wearer at a location generally above the wearer's ears. The ear flaps 4 and 5 extend downwardly from the ring-shaped member 2 for covering a user's ears. The cross-member 3 extends from opposite edges of the ring-shaped member 2 from a position generally above the ear flaps 4 and 5. The visor 6 extends forwardly from the forward bottom edge of the ring-shaped member 2 and the forward edge of the ear flaps 4 and 5. The chin strap 7 is permanently attached to the left ear flap 4 as by an adhesive or other suitable means. The opposite end of the chin strap 7 is free to be inserted through a hole or slot provided therefor (not shown) in the right ear flap 5, as will be further described below.

Figure 5:
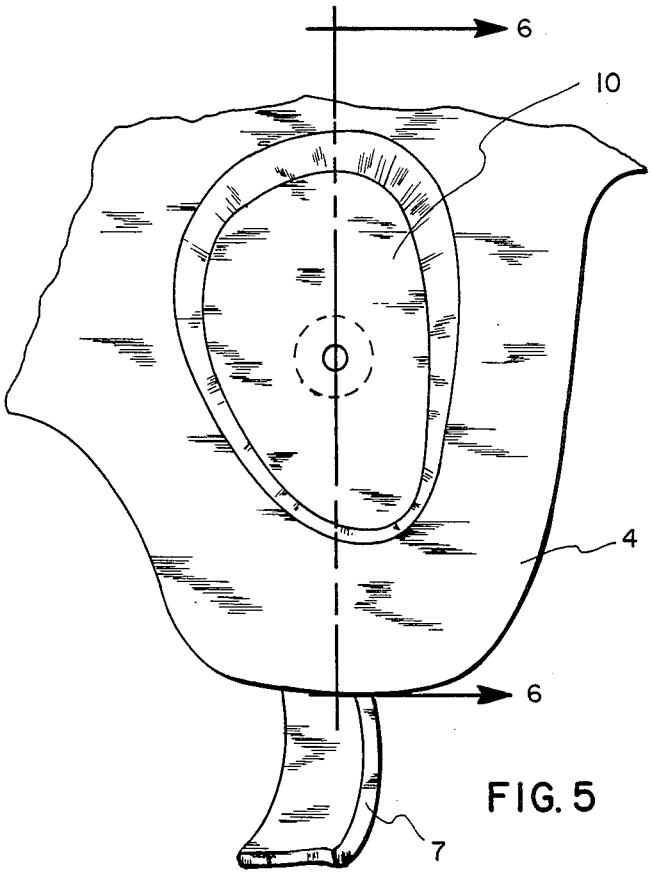
FIG. 5 is an inside view of one of the ear flap members of the embodiment of FIG. 1.
Figure 6:
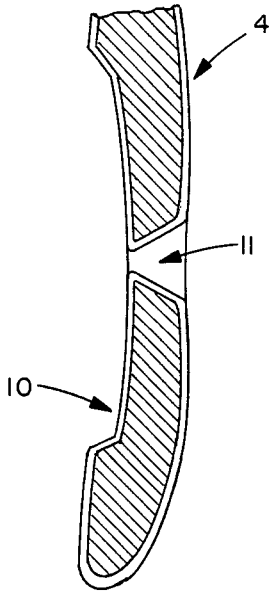
FIG. 6 is a cross-sectional view taken along line 6—6 of FIG. 5.
Figure 7:
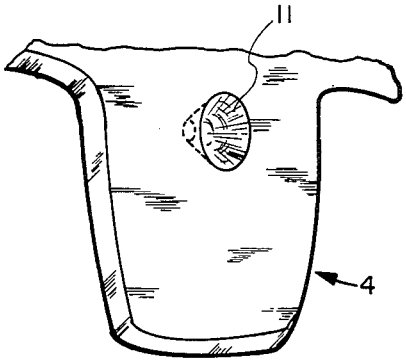
FIG. 7 is a perspective view of the exterior of an ear flap of the embodiment of FIG. 1, showing a conically shaped auditory passageway according to the present invention.

Referring to FIGS. 5, 6 and 7, there is provided in each of the ear flaps 4 and 5 a shallow, generally ear-shaped cavity 10. The cavity 10 is provided for receiving and enclosing a wearer's ear.

Extending from the cavity 10 through the ear flaps 4 and 5 to the outside of the ear flaps 4 and 5 there is provided a conically shaped auditory passageway 11. In the embodiment shown in the figures, the smallest cross-section of the passageway 11 is located at the cavity end of the passageway and the largest cross-section of the passageway 11 is located at the outside of the ear flaps. The shape and size of the passageway 11 is chosen to facilitate hearing while at the same time minimizing the ingress of wind and water into the wearer-'ear.

Figure 8:
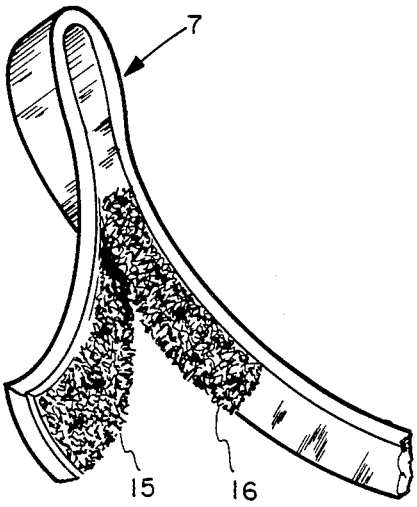
FIG. 8 is a partial perspective view of a chin strap according to the present invention.

Referring to FIG. 8, there is provided on the free end of the chin strap 7 a velcro-type fastener comprising a pair of strips 15 and 16 of looped and hooked material, respectively. As will be seen in FIG. 8, the strip 15 extends from the end of the chin strap 7 a predetermined distance. The strip 16 is spaced from the strip 15 such that when the chin strap 7 is threaded through the slot in the ear flap 5, the strips 15 and 16 may be removably joined by pressure to adjustably secure the head gear 1 on the wearer's head. By varying the length and position of the strip 16, the degree of adjustment available for adjusting the chin strap may be changed.

Figure 9:
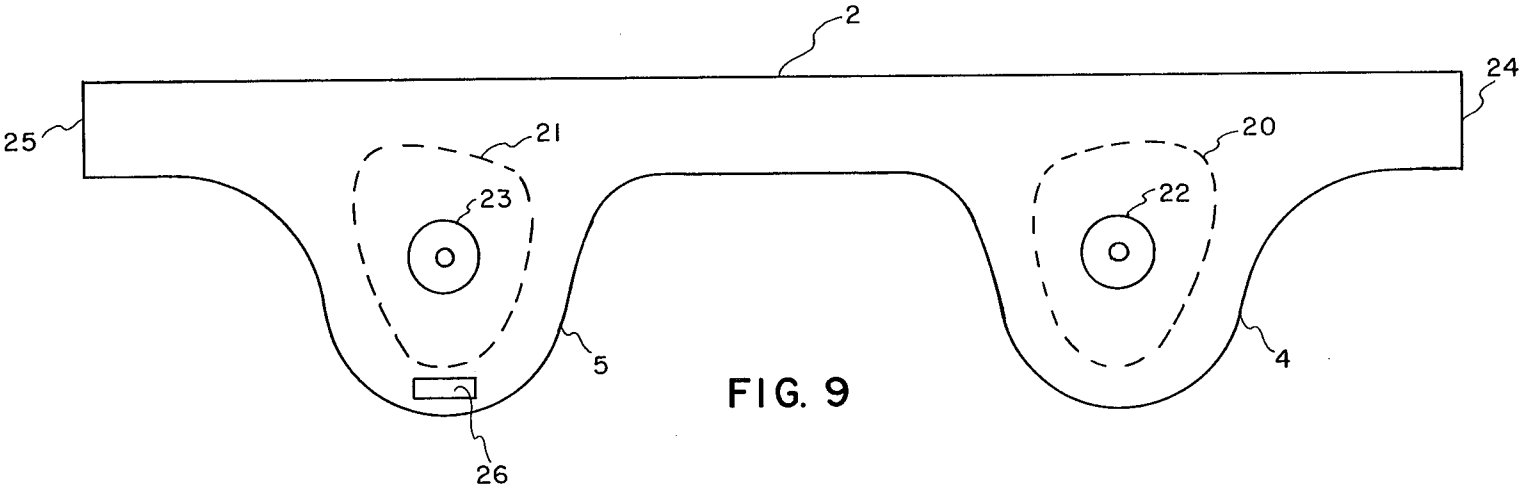
FIG. 9 is a plan view of the ring-shaped and ear flap members of FIG. 1 prior to assembly.
Figure 11:
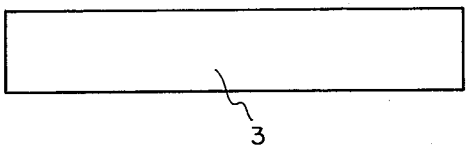
FIG. 11 is a plan view of the cross-member of FIG. 1 prior to assembly.
Figure 10:
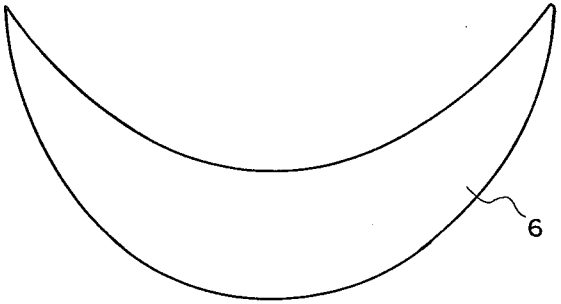
FIG. 10 is a plan view of the visor of FIG. 1 prior to assembly.

Referring to FIGS. 9–11 with the exception of the chin strap 7, which is preferably made from nylon, neoprene, rubber, or the like, the remaining parts of the head gear 1 are preferably cut from a sheet of soft, resilient, closed-cell foam type material, such as the closed-cell material known as Ensolite which is available from Uniroyal, Inc. of Mishawaka, Ind. To form the ring-shaped member 2 and the ear flaps 4 and 5, two pieces having the general shape shown in FIG. 9 are cut from a $\frac{1}{8}$ inch sheet of the closed-cell material. In one of the sheets an ear-shaped hole is cut in each of the ear flap portions 4 and 5, as shown by the dashed lines 20 and 21, respectively. In the second sheet, a conically-shaped hole is provided in the ear flap portions 4 and 5, as shown by the solid lines 22 and 23, respectively. After these steps are performed, the two pieces are overlaid and bonded together as by an adhesive forming the cavity 10 and auditory passageway 11, described above with respect to FIGS. 5 and 6. Thereafter, the ends of the ring-shaped member 2 designated 24 and 25 are bonded together. After the ends 24 and 25 are bonded together, the cross-member 3 and visor 6 are bonded to the ring-shaped member 2, as shown in FIG. 1, for forming the head gear 1. After the head gear 1 is assembled, the closed-cell material is provided with a watertight covering such as vinyl or the like, as by spraying or dipping. Thereafter, the chin strap 7 is bonded to the ear flap 4, the free end of which will be subsequently passed through a hole 26 provided therefor in the lower end of the ear flap 5.

While a preferred embodiment and suggested alternative embodiments of the present invention are described above, it is contemplated that still other changes may be made thereto without departing from the spirit and scope of the present invention. For example, the orientation of the auditory passageway 11 may be reversed. The shape of the passageway itself may be formed with a shape other than a conical shape. A cap of material from which extends the visor and ear flaps, as described above, may replace the cross-member 3. A means may be provided for adjusting the size of the head gear 1 so that a single head gear 1 can be fitted snugly to a wearer's head over a wide range of sizes and various colors and other types of decorative features may be used for enhancing the appearance and visibility of the head gear 1. Moreover, while described for use in water sports, it will be appreciated that head gear 1 may be used and provide head, eye and ear protection during other types of sports activities such as skiing and the like. Accordingly, it is intended that the embodiments described above be considered only as illustrative of the invention and that the scope of the invention be determined by the claims hereinafter provided.

What is claimed is:

1. A floatable, lightweight protective sports head gear comprising:

a retaining means for retaining said head gear on a user's head, said retaining means including a ring-shaped member for extending around a user's head;

a transverse strip for extending over the top of a user's head from opposite edges of said ring-shaped member;

chin strap means;

ear protecting means, said ear protecting means including a pair of members which extend from opposite edges of said ring-shaped member for covering a user's ears and from which said chin strap means extends, a cavity located in each of said ear covering members for receiving a user's ear and a fluid and air passageway which extends from said cavity through and to the outside of said ear covering member; and sun visor means which extends from said ring-shaped member, and wherein said retaining means, said ear protecting means and said sun visor means are made from a soft, resilient closed-cell material which is entirely enclosed within a soft, flexible, watertight covering.

2. A head gear according to claim 1 wherein said watertight covering comprises a layer of vinyl material which extends over all of said closed-cell material.

3. A head gear according to claim 1 wherein said passageway comprises a non-uniform cross-section.

4. A head gear according to claim 3 wherein said cross-section is larger at the exterior end of said passageway than at the cavity end of said passageway.

5. A head gear according to claim 4 wherein said cross-section comprises a generally conically-shaped cross-section.

6. A floatable, lightweight protective sports head gear comprising:

a pair of ear protecting members for covering a user's ears, each of said members having a cavity for receiving a user's ear and a passageway which extends from said cavity through and to the outside of said ear protecting member;

a sun visor;

a chin strap adapted to extend between said ear protecting members beneath a user's chin;

retaining means adapted to extend around and over the top of a user's head for use in conjunction with said chin strap for retaining said sun visor and said ear protecting members on a user's head; and wherein said ear protecting members, said sun visor and said retaining means are made from a soft, resilient closed-cell material which is entirely enclosed within a soft, flexible, watertight covering.

7. A head gear according to claim 6 wherein said watertight covering comprises a layer of vinyl material which extends over all of said closed-cell material.

* * * * *